US010995557B2

(12) United States Patent
Grosz et al.

(10) Patent No.: US 10,995,557 B2
(45) Date of Patent: May 4, 2021

(54) METHOD OF MANUFACTURING AND DESIGNING A HYBRID DRILL BIT

(71) Applicant: Halliburton Energy Services, Inc., Houston, TX (US)

(72) Inventors: Gregory Christopher Grosz, Houston, TX (US); Seth Garrett Anderle, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/605,301

(22) PCT Filed: Aug. 17, 2017

(86) PCT No.: PCT/US2017/060700
§ 371 (c)(1),
(2) Date: Oct. 15, 2019

(87) PCT Pub. No.: WO2019/094011
PCT Pub. Date: May 16, 2019

(65) Prior Publication Data

US 2020/0386056 A1 Dec. 10, 2020

(51) Int. Cl.

| | |
|---|---|
| ***E21B 10/20*** | (2006.01) |
| ***E21B 10/14*** | (2006.01) |
| ***E21B 10/62*** | (2006.01) |
| ***E21B 10/42*** | (2006.01) |

(52) U.S. Cl.
CPC ..... *E21B 10/20* (2013.01); *E21B 10/14* (2013.01); *E21B 10/62* (2013.01); *E21B 10/42* (2013.01)

(58) Field of Classification Search
CPC ..... E21B 10/20; E21B 10/14; E21B 10/42
See application file for complete search history.

(56) References Cited

U.S. PATENT DOCUMENTS 2,975,849 A * 3/1961 Stuart ..... E21B 10/04 175/333
2,994,389 A * 8/1961 Bus, Sr. ..... E21B 10/26 175/321
3,055,443 A * 9/1962 Edwards ..... E21B 10/04 175/405.1

(Continued)

FOREIGN PATENT DOCUMENTS

WO 2015191028 12/2015

OTHER PUBLICATIONS

ISRWO International Search Report and Written Opinion for PCT/US2017/060700 dated Aug. 2, 2018.

*Primary Examiner* — Blake E Michener
(74) *Attorney, Agent, or Firm* — Thomas Rooney; C. Tumey Law Group PLLC

(57) ABSTRACT

A method of manufacturing, assembling, configuring, and/or using a hybrid drill bit is disclosed. An illustrative example includes inserting a rolling cutting structure into a central bore of a bit body through an upper connector section of the bit body toward a lower end portion of the bit body. The bit body has a rotational axis and a plurality of blades at the lower end portion. The upper connector section is configured to be coupled to a lower end of a drill string. Each of the plurality of blades extends radially from the bit body about the rotational axis at the lower end portion and includes a plurality of cutters embedded therein.

18 Claims, 6 Drawing Sheets

(56) References Cited

U.S. PATENT DOCUMENTS

| | | | | |
|---|---|---|---|---|
| 3,306,377 | A | 2/1967 | Johnson | |
| 3,387,673 | A | 6/1968 | Thompson | |
| 5,016,718 | A * | 5/1991 | Tandberg | E21B 10/04 175/333 |
| 5,145,017 | A * | 9/1992 | Holster | E21B 10/04 175/333 |
| 6,439,326 | B1 * | 8/2002 | Huang | E21B 10/14 175/334 |
| 7,845,435 | B2 | 12/2010 | Zahradnik et al. | |
| 8,141,664 | B2 | 3/2012 | Zahradnik et al. | |
| 8,336,646 | B2 | 12/2012 | Kulkarni | |
| 8,356,398 | B2 | 1/2013 | McCormick et al. | |
| 8,678,111 | B2 | 3/2014 | Zahradnik et al. | |
| 2010/0181112 | A1 * | 7/2010 | Radford | E21B 10/26 175/57 |
| 2011/0162893 | A1 | 7/2011 | Zhang | |
| 2012/0273275 | A1 * | 11/2012 | Broussard, Jr. | E21B 7/002 175/57 |
| 2013/0220706 | A1 | 8/2013 | Azar et al. | |
| 2013/0228382 | A1 * | 9/2013 | Sauvageau | E21B 10/60 175/331 |
| 2013/0313021 | A1 | 11/2013 | Zahradnik et al. | |
| 2014/0353046 | A1 | 12/2014 | Zhang et al. | |
| 2016/0251902 | A1 | 9/2016 | Zahradnik et al. | |
| 2016/0319602 | A1 | 11/2016 | Zhang | |
| 2018/0202231 | A1 * | 7/2018 | Anderle | E21B 10/43 |
| 2020/0165876 | A1 * | 5/2020 | Dunbar | E21B 10/26 |

* cited by examiner

METHOD OF MANUFACTURING AND DESIGNING A HYBRID DRILL BIT

TECHNICAL FIELD

The present disclosure generally relates to formation of downhole tools, and more specifically, to drill bits including both fixed and rotational cutting elements thereon.

BACKGROUND

Often in operations for the exploration, drilling and production of hydrocarbons, water, geothermal energy or other subterranean resources, a rotary drill bit is used to form a wellbore through a geologic formation. Rotary drill bits may generally be classified as either fixed-cutter drill bits or roller-cone drill bits, either of which may be installed at the end of a drill string and rotated (hence, rotary) to cut the formation. Whether to use a fixed-cutter bit or a roller-cone bit depends on the particular formation and cost/performance objectives, as the two types perform differently in different types of formations.

Fixed-cutter drill bits are often referred to as "drag bits" due to having a plurality of cutters mounted to the bit body at fixed positions. The bit body for a fixed-cutter drill bit may be constructed of a metallic material such as steel or a matrix material formed by infiltrating a reinforcement material with a molten binder. The cutters can be affixed to an outer profile of the bit body such that hard surfaces on the cutters are exposed to the geologic formation when forming a wellbore. The cutters generally operate to remove material from the geologic formation, typically by shearing formation materials as the drill bit rotates within the wellbore.

Roller-cone drill bits may be constructed of one or more roller cones rotatably mounted to the bit body, wherein cutters mounted at fixed positions on the roller cones rotate with the roller cones. The roller cones roll along the bottom of a wellbore in response to rotation of the roller-cone drill bit at the end of the drill string. The cutters on the roller cones generally operate to remove material from the geologic formation, typically by crushing, gouging and/or scraping material from the geologic formation to drill the wellbore. Hybrid drill bits have been developed with features of both fixed-cutter and roller-cone drill bits for various purposes. For example, in some instances, a hybrid drill bit may be more durable, thereby permitting greater depths to be drilled before requiring maintenance or replacement of the drill bit than either a fixed-cutter drill bit or roller-cone drill bit alone.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
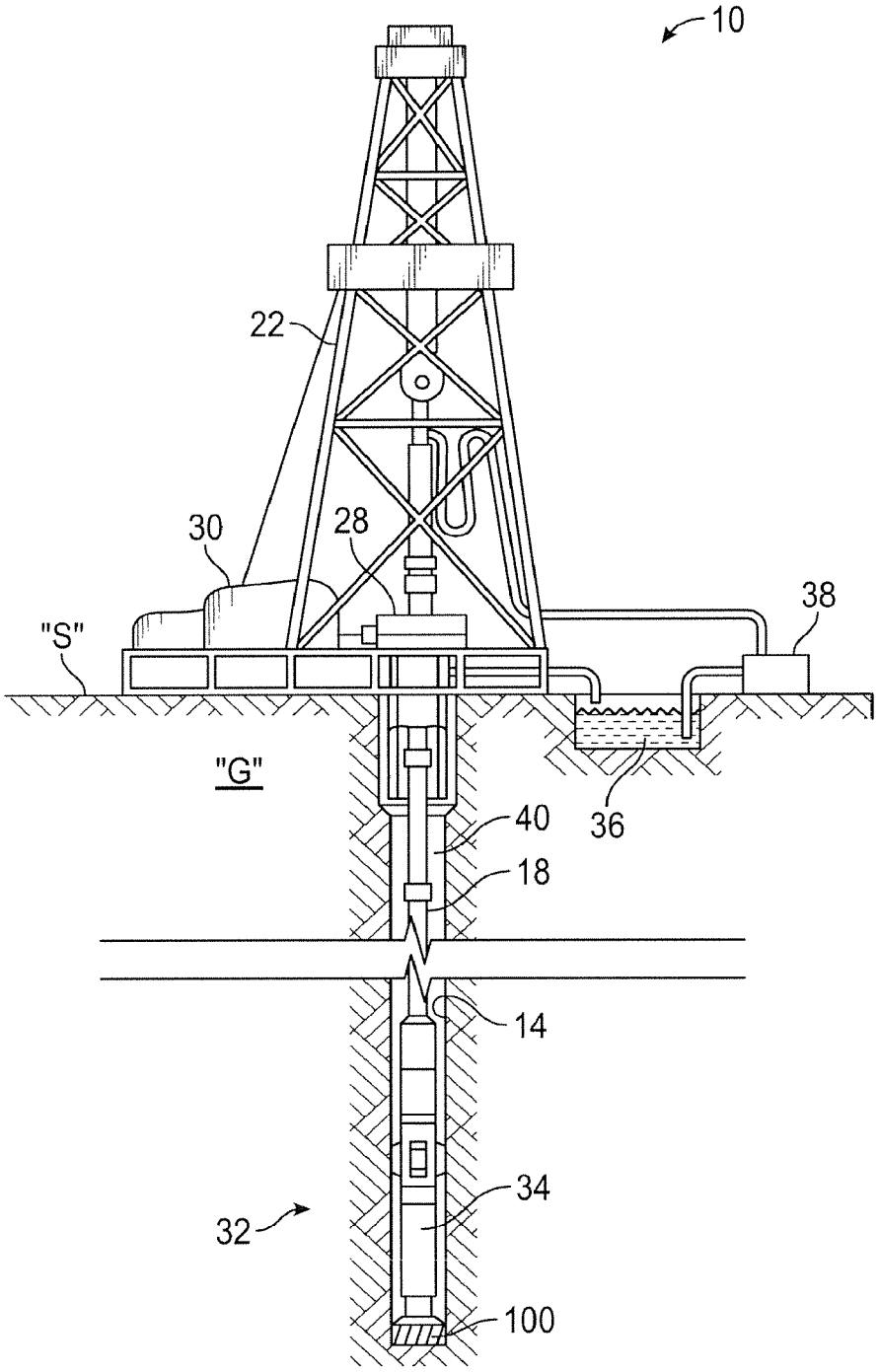
FIG. 1 illustrates a drilling system incorporating a hybrid drill bit, according to some embodiments.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, up-hole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the downhole direction being toward the toe of the wellbore.

Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a figure may depict an onshore or terrestrial operation, it should be understood by those skilled in the art that the apparatus according to the present disclosure is equally well suited for use in offshore operations. Further, unless otherwise noted, even though a figure may depict a wellbore that is partially cased, it should be understood by those skilled in the art that the apparatus according to the present disclosure may be equally well suited for use in fully open-hole wellbores.

The present disclosure relates to hybrid drill bits that include blades disposed around a periphery of the drill bits and a rolling cutting structure including a pair of counter-rotational cutting members centrally located in the hybrid drill bits. Rotation of the drill bit carries the peripherally located blades along a relatively long circumferential path which may facilitate shearing of geologic material from a formation. The pair of counter-rotational cutting members roll in a relatively short circumferential area to crush and scrape geologic material near a rotational axis of the drill bits. The counter-rotational cutting members may be mounted on axes that are generally perpendicular to the rotational axis and may be positioned to define a cutting depth of the blades. The cutting depth may further be defined or limited by the aggressiveness of the counter-rotational cutting members providing depth of cut limiting features.

A hybrid drill bit may be formed by mounting a rolling cutting structure, e.g. a pair of counter-rotational cutting members, in a center of the blades of a traditional drill bit. Therefore, at least a portion of each of the blades defining the upper portion of the drill bit would need to be removed in order to create the opening into which the center-mounted cutting structure would be placed. The center-mounted cutting structure would thus be limited in size to a size of the opening defined in the upper portion of the drill bit in order to accommodate passage of the center cutting element through the opening. As described above, such a drill bit would require that material from the actual drill bit body be omitted, such as by reducing the size of the blades or reducing the number of the cutters.

In accordance with some embodiments, the present disclosure aims to provide a hybrid drill bit in which a size of the center-mounted rolling cutting structure (e.g., the pair of counter-rotational cutting members) is not limited by the size of an opening defined in the lower portion of the drill bit body. That is, the pair of counter-rotational cutting members is inserted onto the bit body through an aperture along the axis of the bit body (the aperture referred to herein as the central bore), from the connector section of the bit body, which obviates the need to remove or omit material from or otherwise design the actual drill bit body in order to make room for the pair of counter-rotational cutting members. This is in contrast to the hybrid drill bits having the center cutting structure inserted onto the drill bit body through the upper portion of the bit body, which necessitate that the center cutting structure be sufficiently small enough to fit through the opening on the upper portion of the bit body in order to be mounted onto the drill bit.

In accordance with at least some embodiments disclosed herein is the realization that when the forces act through a centerline of the perpendicular bearing of the hybrid drill bit having the center cutting structure inserted onto the drill bit body through the upper portion of the bit body, the cutters of the center cutting structure begin to shear more geologic material than what they roll and crush (thus not functioning as intended). The stress and wear due to shear forces creates the risk that some portions of the cutters break off from the center cutting structure, along with other issues related to increased wear. Various embodiments disclosed herein address this deficiency of the hybrid drill bits having the center cutting structure inserted onto the drill bit body through the upper connector section of the bit body along the rotational axis towards the lower end portion. This is achieved by providing a drill bit configuration that decreases the area through which the center cutting structure (in the embodiments described herein the center cutting structure is a pair of counter-rotational cutting members) is required to work. This configuration permits the blades of the drill bit to be used for handling shear forces while the center cutting structure (i.e., pair of counter-rotational cutting members) primarily acts against the formation to roll and crush the formation and minimize excessive shear forces. Thus, various embodiments disclosed herein can provide hybrid drill bits that exhibit increased useful life and wear compared to the previously disclosed hybrid drill bits.

Further, in accordance with at least some embodiments is the realization that traditional methods of mounting the roller cone bits to drill bit body, in which the roller cone bit is installed from the face side of the bit, limit the possible configurations and placement of the fixed cutting structures (e.g., polycrystalline diamond cutters or "PDCs"), at least requiring that the fixed cutting structures be displaced sufficiently from the central axis at the face of the drill bit in order for the roller cone bit to be inserted into the bit body and fit between the fixed cutting structures.

FIG. 1 illustrates a drilling system 10 incorporating an exemplary hybrid drill bit 100. In some embodiments, drilling system 10 is partially disposed Within a wellbore 14 extending from a surface location "S" and traversing a geologic formation "G." In the illustrated example, the wellbore 14 is shown generally vertical, though it will be understood that the wellbore 14 may include any of a wide variety of vertical, directional, deviated, slanted and/or horizontal portions therein, and may extend along any trajectory through the geologic formation "G."

The hybrid drill bit 100 is provided at a lower end of a drill string 18 for cutting into 10 the geologic formation "G." When rotated, the hybrid drill bit 100 operates to break up and generally disintegrate the geological formation "G." The hybrid drill bit 100 may be rotated in any of a variety of ways. In this example, at the surface location "S" a drilling rig 22 includes a turntable 28 that may be operated to rotate the entire drill string 18 and the hybrid drill bit 100 coupled to the lower end of the drill string 18. The turntable 28 is selectively driven by an engine 30, chain-drive system, or other apparatus.

In some embodiments, a bottom hole assembly (BHA) 32 provided in the drill string 18 may include a rotary steerable system or downhole motor 34 to selectively rotate the hybrid drill bit 100 with respect to the rest of the drill string 18. In some aspects where a motor is used, the motor 34 may generate torque in response to the circulation of a drilling fluid, such as mud 36, therethrough. As those skilled in the art will recognize, the ability to selectively rotate the hybrid drill bit 100 relative to the drill string 18 may be useful in directional drilling, and/or for other operations as well. The mud 36 may be pumped downhole by mud pump 38 through an interior of the drill string 18. Thus, the mud 36 passes through the downhole motor 34 of the BHA 32 where energy is extracted from the mud 36 to turn the hybrid drill bit 100. As the mud 36 passes through the BHA 32, the mud 36 may lubricate bearings (not explicitly shown) defined therein before being expelled through nozzles 124 (FIG. 2A) defined in the hybrid drill bit 100. The mud 36 works to flush geologic cuttings and/or other debris from the path of the hybrid drill bit 100 as it continues to circulate back up through an annulus 40 defined between the drill string 18 and the geologic formation "G." The geologic cuttings and other debris are carried by the mud 36 to the surface location "S" where the cuttings and debris can be removed from the mud stream.

In other aspects, where a rotary steerable system is used, the system may be programmed by a measurement while drilling (MWD) engineer or directional driller who transmits commands using surface equipment (typically using either pressure fluctuations in the mud column or variations in the drill string rotation) which the system responds to, and gradually steers into the desired direction. That is, the rotary steerable system may be designed to drill directionally with continuous rotation from the surface, eliminating the need to pass the mud through a motor.

Figure 2A:
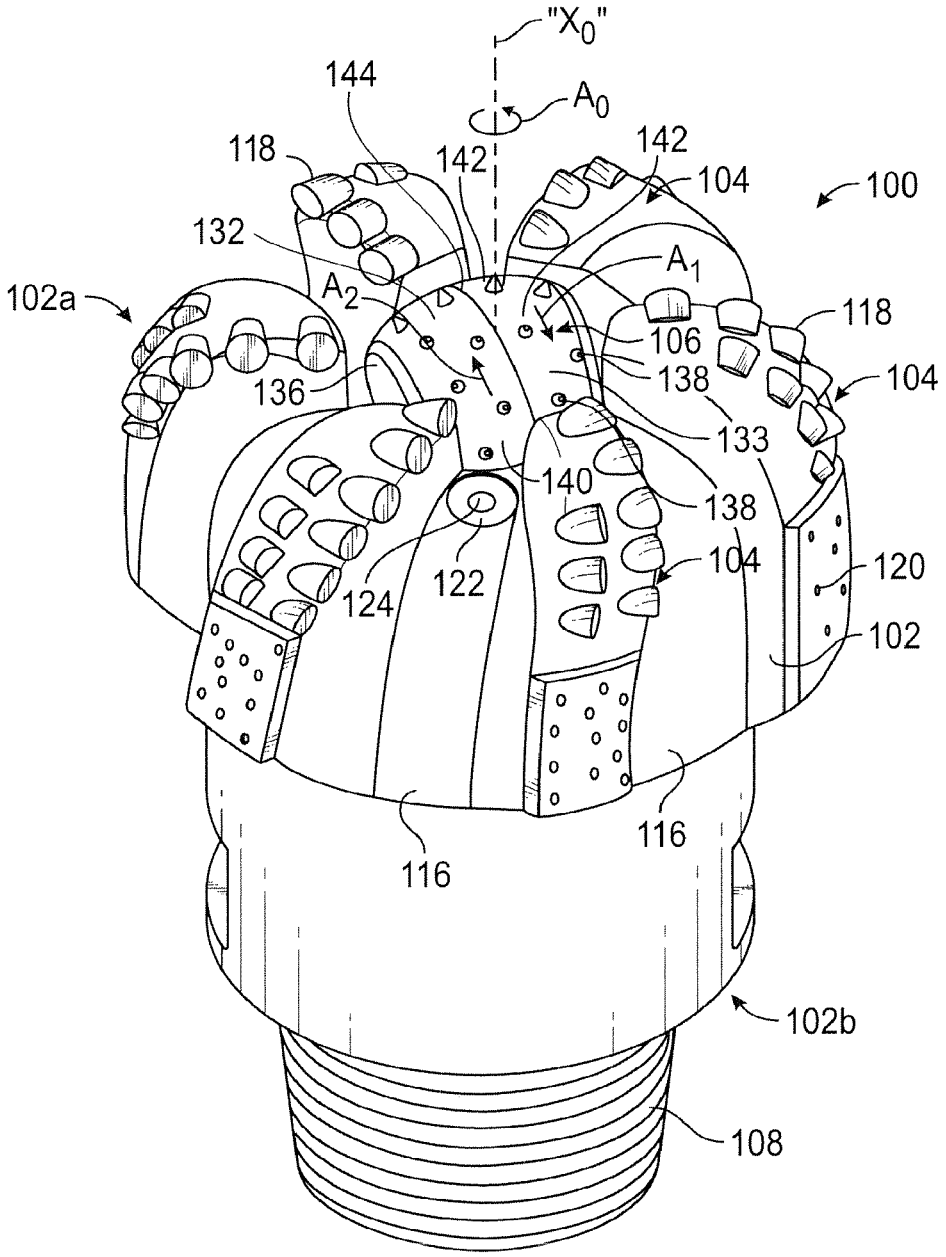
FIG. 2A illustrates a perspective top view of the hybrid drill bit of FIG. 1, including a plurality of blades defined by a drill bit body and a rolling cutting structure circumscribed by the plurality of blades, according to some embodiments.
Figure 2B:
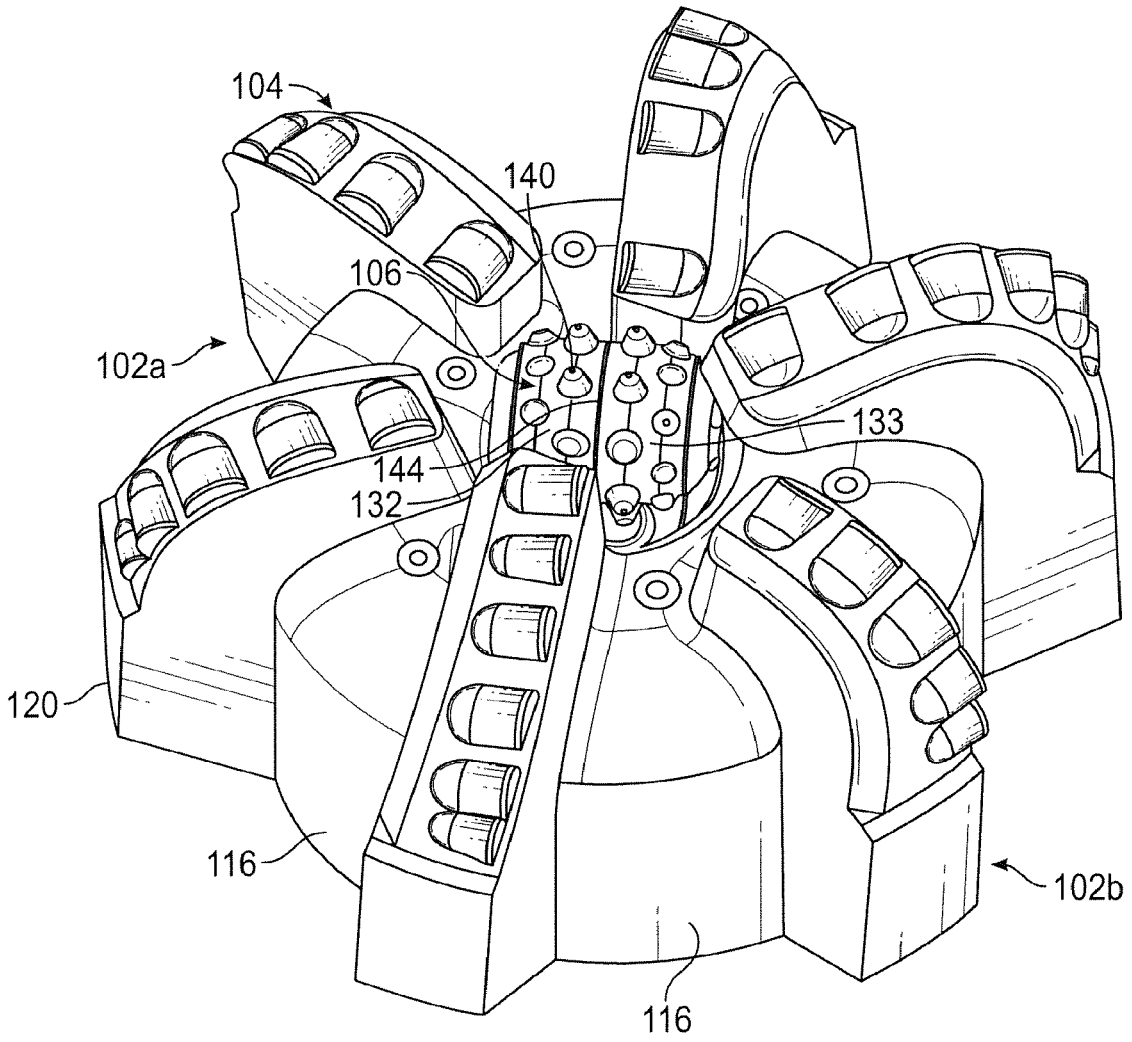
FIG. 2B illustrates a perspective side view of the hybrid drill bit of FIG. 1, according to some embodiments.

FIG. 2A illustrates a perspective side view of the exemplary hybrid drill bit of FIG. 1, including a plurality of cutting blades 104 defined by a drill bit body and a rolling cutting structure 106 circumscribed by the plurality of cutting blades 104. FIG. 2B illustrates a perspective top view of the exemplary hybrid drill bit of FIG. 1.

As illustrated in FIG. 2A, the hybrid drill bit 100 may include a bit body 102 having a rotational axis $X_0$, a central bore 150, the central bore being an aperture defined along the rotational axis $X_0$ of the bit body 102, and a lower end portion 102*a*. The hybrid drill bit 100 may further include a plurality of blades 104 at the lower end portion 102*a*, and an upper connector section 102*b* for coupling to a lower end of the drill string 18. The drill bit 100 may also include a connector 108 extending from the bit body 102 and disposed at the upper connector section 102*b* of the drill bit 100. The connector 108 can be configured in accordance with any of various types of connectors for coupling the hybrid drill bit 100 to the drill string 18 (FIG. 1). In some embodiments, the connector 108 may include a threaded pin with American Petroleum Institute (API) threads defined thereon. The bit body 102 defines a bit body rotational axis "$X_0$" extending between a leading end 102*a* and a trailing end 102*b* thereof. In some embodiments, the bit body 102 may be constructed of matrix material formed by infiltrating a reinforcement material, e.g., tungsten carbide powder with a molten binder material, e.g., copper, tin, manganese nickel and zinc as appreciated by those skilled in the art. Alternatively, the bit body 102 may be constructed of a metallic material such as steel or any of various metal alloys generally associated with manufacturing rotary drill bits.

In accordance with some embodiments, the plurality of blades 104 may extend radially from the bit body 102 about the rotational axis $X_0$ at the lower end portion 102*a* of the bit body 102. Each of the plurality of cutting blades 104 may include a plurality of cutters 118 embedded therein. The hybrid drill bit 100 may also include a rolling cutting structure 106, and junk slots 116 defined between the cutting blades 118. In some embodiments, the rolling cutting structure may be a pair of counter-rotational cutting members configured to be inserted into the central bore 150 from the upper connector section 102*b* of the bit body along the rotational axis toward the lower end portion 102*a*.

In some embodiments, the cutting blades 104 are asymmetrically arranged about the bit body rotational axis "$X_0$." The junk slots 116 facilitate the removal of geologic materials and debris from the path of the hybrid drill bit 100, e.g., by providing a flow path for drilling mud 36 (FIG. 1) around the bit body 102. The cutters 118 are mounted for maintaining a position and orientation with respect to the bit body 102 as the hybrid drill bit 100 is rotated about the bit body rotational axis "$X_0$."

In some embodiments, the cutters 118 may be securely embedded in the cutting blades 114 by brazing or other manufacturing techniques recognized in the art. The cutters 118 engage and remove adjacent portions of the geologic formation "G" (FIG. 1), generally by shearing the geologic materials from the bottom and sides of a wellbore 14 (FIG. 1) as the hybrid drill bit 100 rotates downhole. In some embodiments, the cutters 118 may include various types of polycrystalline diamond compact (PDC) cutter components. Gauge elements 120 are provided on radially outward surfaces at a trailing end of each cutting blade 114. The gauge elements 120 may be constructed of any of the hard materials described above for construction of the cutters 118 and operate to maintain a diameter of the wellbore 14 (FIG. 1).

Figure 3A:
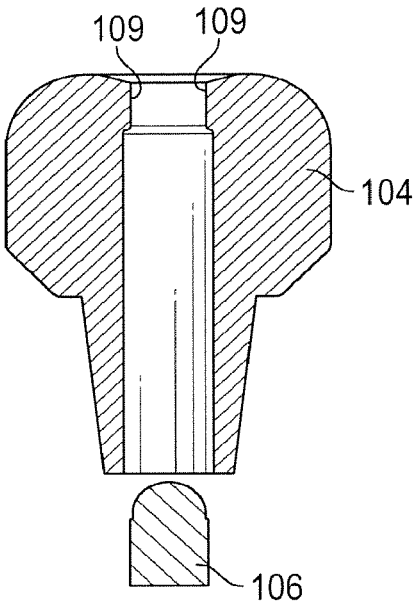
FIGS. 3A, 3B, and 3C illustrate side and cross-sectional views of the drill bit of FIG. 1, and an exemplary method of forming the hybrid drill bit, including insertion of the rolling cutting structure into the drill bit body though a connector side of the drill bit body, according to some embodiments.
Figure 3B:
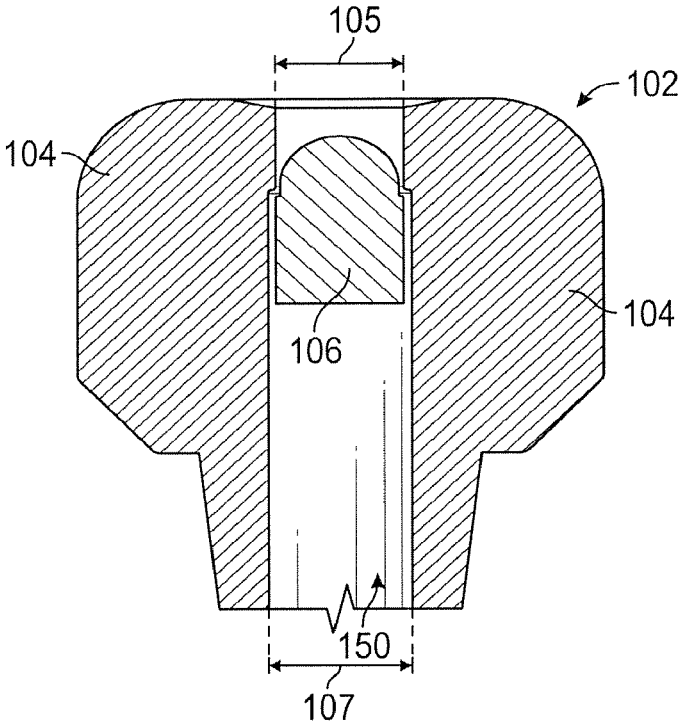
Figure 3C:
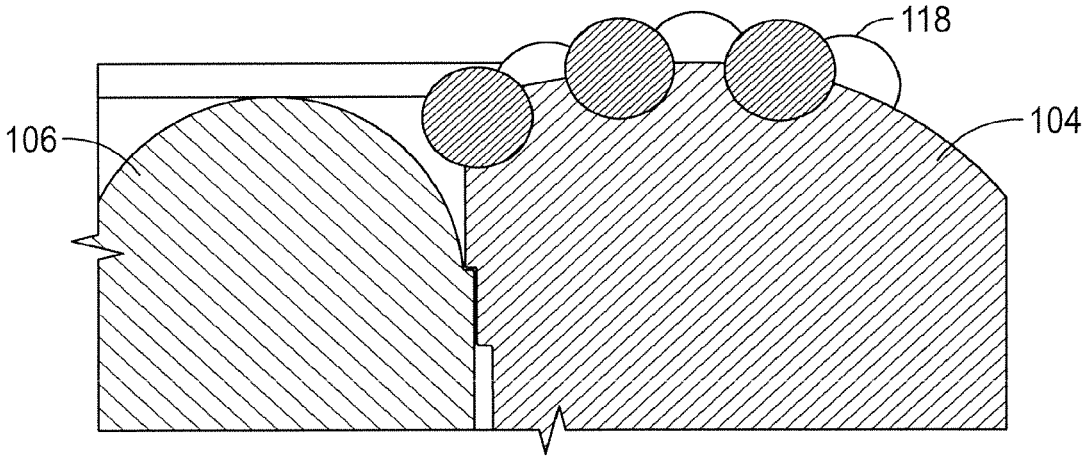

FIGS. 3A, 3B, and 3C illustrate side, cross-sectional views of the drill bit of FIG. 1, and in particular, illustrate the insertion of the pair of counter-rotational cutting members into the drill bit body though an upper connector section 102*b* of the drill bit body, according to some embodiments.

In accordance with some embodiments, each of the blades 104 includes a radially innermost cutter 118 embedded therein. In these embodiments, the plurality of radially innermost cutters 118 define an opening therebetween at the lower end portion 102*a* of the bit body 102. The pair of counter-rotational cutting members 106 may be mounted in the bit body central bore 150 and positioned relative to the radially innermost cutters 118 to provide a predetermined exposure of the pair of counter-rotational cutting members through the opening.

In some embodiments, the pair of counter-rotational cutting members 106 may be disposed within a central bore 150 defined in the bit body 102 and at a center of the plurality of blades 104. At least a portion of the pair of counter-rotational cutting members 106 may be exposed to the geologic formation through the opening 105.

In accordance with some embodiments, a diameter or cross-sectional profile of the rolling cutting structure (e.g., the pair of counter-rotational cutting members) 106 (and/or a size of the central bore 150) may be larger than a size of the opening 105, which can provide various advantages, as discussed further below. For example, the size of the opening 105 may be measured as a diameter of an inscribed circle that intersects innermost surfaces, aspects, or edges 109 of each of the plurality of blades 104 (see FIG. 3A). Similarly, the size of the bore 150 may be a diameter of the bore 150. Thus, a diameter or cross-sectional profile of the pair of counter-rotational cutting members 106 (and/or a diameter 107 of the central bore 150) may be larger than a diameter 105 of the central bore 150 at the opening 105, while still permitting the pair of counter-rotational cutting members 106 to be accommodated therein.

Thus, in some embodiments, the size of the pair of counter-rotational cutting members 106 is not limited by a size of the opening 105 on the lower end portion 102*a* of the bit body 102. Since the pair of counter-rotational cutting members 106 is inserted onto the bit body 102 through the central bore 150 from the upper connector section 102*b* of the bit body 102, this obviates the need to remove or omit material from or otherwise design the actual drill bit body 102 in order to make room for the pair of counter-rotational cutting members 106. This contrasts with the hybrid drill bits in which the center cutting structure is inserted into the drill bit body through the lower end portion 102*a* (i.e., the outside) of the bit body, thereby necessitating that the opening on the lower end portion 102*a* of the bit body be sufficiently large to accommodate passage of the center cutting structure through the opening. Thus, the hybrid drill bits having the center cutting structure require that material from the actual drill bit body be omitted. For example, the material may be omitted by reducing the size of the blades, or reducing the number of the cutters, in order to enlarge the opening sufficiently to permit the center cutting structure to pass therethrough. Thus, implementation of some embodiments disclosed herein can effectively reduce material waste, manufacturing time, and overall costs of the bit manufacturing process while providing a drill bit that includes additional cutters and larger blades relative to conventional hybrid drill bits.

In accordance with some embodiments, the bit body 102 can comprise a plurality of nozzle openings 122. Respective nozzles 124 may be disposed in each nozzle opening 122 for expelling various types of drilling fluid or mud 36 (FIG. 1) pumped through the drill string 18 (FIG. 1). The nozzle openings 122 are fluidly coupled to a fluid passageway 128

(FIG. 4B) extending through the hybrid drill bit 100. In some embodiments, the centrally located pair of counter-rotational cutting members 106 may also include nozzles 127 that are fluidly coupled to the fluid passageway 128. The fluid passageway 128 extends through the bit body 102 and the connector 108 such that the fluid passageway 128 may be fluidly coupled to the drill string 18 (FIG. 1).

Referring again to FIG. 3A, FIG. 3B, and FIG. 3C, these figures illustrate an exemplary method of manufacturing or forming the hybrid drill bit 100 by inserting the rolling cutting structure 106 into the drill bit body 102 though the upper connector section 102*b* of the drill bit body 102.

In accordance with some embodiments, the method of forming the hybrid drill bit 100 for drilling through a geologic formation G, may include forming the drill bit body 102, as described above, by infiltrating a reinforcement material with a binder material in a mold having a cavity for defining the drill bit body 102, and coupling the connector 108 to an upper connector section 102*b* of the drill bit body 102. As described above, in some embodiments, the connector 108 may include a threaded pin with American Petroleum Institute (API) threads defined thereon.

As illustrated in FIGS. 3A and 3B, the method of forming the hybrid drill bit 100 may further include coupling, inserting, or installing in the central bore 150 of the bit body 102 defined in a center of the plurality of blades 104. In some embodiments, the rolling cutting structure (e.g., the pair of counter-rotational cutting members) 106 can comprise two counter-rotational cutting members 132, 133. Further, in accordance with some embodiments, the method may further include inserting the rolling cutting structure (e.g., the pair of counter-rotational cutting members) 106 into the central bore 150 from the upper connector section 102*b* of the bit body 102 along the rotational axis $X_0$ toward the lower end portion 102*a* of the drill bit body 102. The aforementioned method of coupling, inserting, or installing the pair of counter-rotational cutting members 106 into the bit body 102 through the upper connector section 102*b* of the bit body 102 advantageously differs from traditional methods of coupling the roller cone bits to drill bit body, where the roller cone bits are traditionally attached to the face of the drill bit 100. For example, the present method of inserting the pair of counter-rotational cutting members 106 through the upper connector section 102*b* of the drill bit body 102 is advantageous over the aforementioned conventional coupling methods in that it is not necessary to remove material from the actual drill bit body 102 in order to make room for the pair of counter-rotational cutting members 106. This can reduce material waste, manufacturing time, and overall costs of the bit manufacturing process.

In accordance with some embodiments, the pair of counter-rotational cutting members 106 can be inserted through the existing structure of a central bore formed along the bit body rotational axis "$X_0$." This is in contrast to conventional hybrid drill bits, which generally comprise roller cones inserted between each pair of fixed cutting structures. Furthermore, since conventional hybrid drill bits generally employ configuration of the roller cone bits and the fixed cutting structures are disposed in series with each other, there is no flexibility to modify the roller cone bits in the currently existing central bore of the conventional hybrid drill bit.

Further, as noted above, in accordance with at least some embodiments is the realization that traditional methods of mounting the roller cone bits to drill bit body, in which the roller cone bit is installed from the face side of the bit, limit the possible configurations and placement of the cutting elements or cutters, at least requiring that the fixed cutters be displaced sufficiently from the central axis at the face of the drill bit in order for the roller cone bit to be inserted into the bit body and fit between the fixed cutting structures.

Thus, according to some embodiments disclosed herein, which permit installation of a roller cone or other bit from the upper connector section 102*b*, a user can advantageously design the pair of counter-rotational cutting members 106 and the blades 104 to have designs that were previously impossible. For example, in some embodiments, the pair of counter-rotational cutting members 106 can be configured to radially overlap with the blades 104 to limit the exposure of the pair of counter-rotational cutting members 106 to damage from rocks in the surrounding formation, and thereby ensure that only the most advanced portion of the first and second counter-rotational cutting members 132, 133 of the pair of counter-rotational cutters 106 are in contact with the formation "G". As noted herein, this can tend to minimize the shear load against the pair of counter-rotational cutting members 106 and allow the pair of counter-rotational cutting members 106 to primarily roll and crush the rock. Accordingly, in accordance with some embodiments, forces acting on the counter rotational cutter and exposure ranges of the counter rotational cutter with the formation may be predicted by engineering the amount of roller exposure and formation engagement (as described in more detail below). The forces acting on the counter rotational cutter and exposure ranges may be predicted by varying the exposure angle between the counter rotational cutter 106 and the blade 104, in order to ensure the first and second counter-rotational cutting members 132, 133 of the pair of counter-rotational cutting members 106 continue to roll and not lock up from being over engaged with the rock of the formation "G."

Figure 4A:
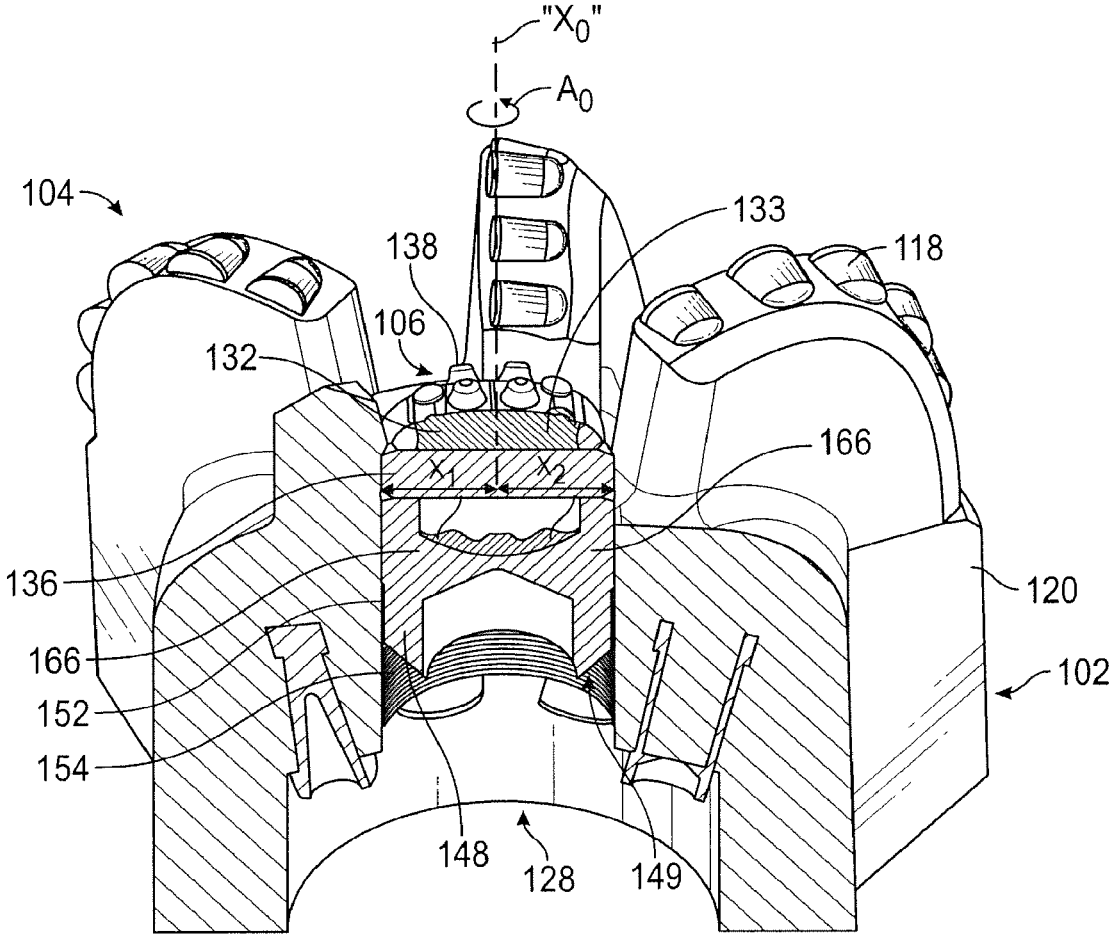
FIGS. 4A and 4B are cross-sectional views of the hybrid drill bit of FIGS. 2A and 2B, according to some embodiments.
Figure 4B:
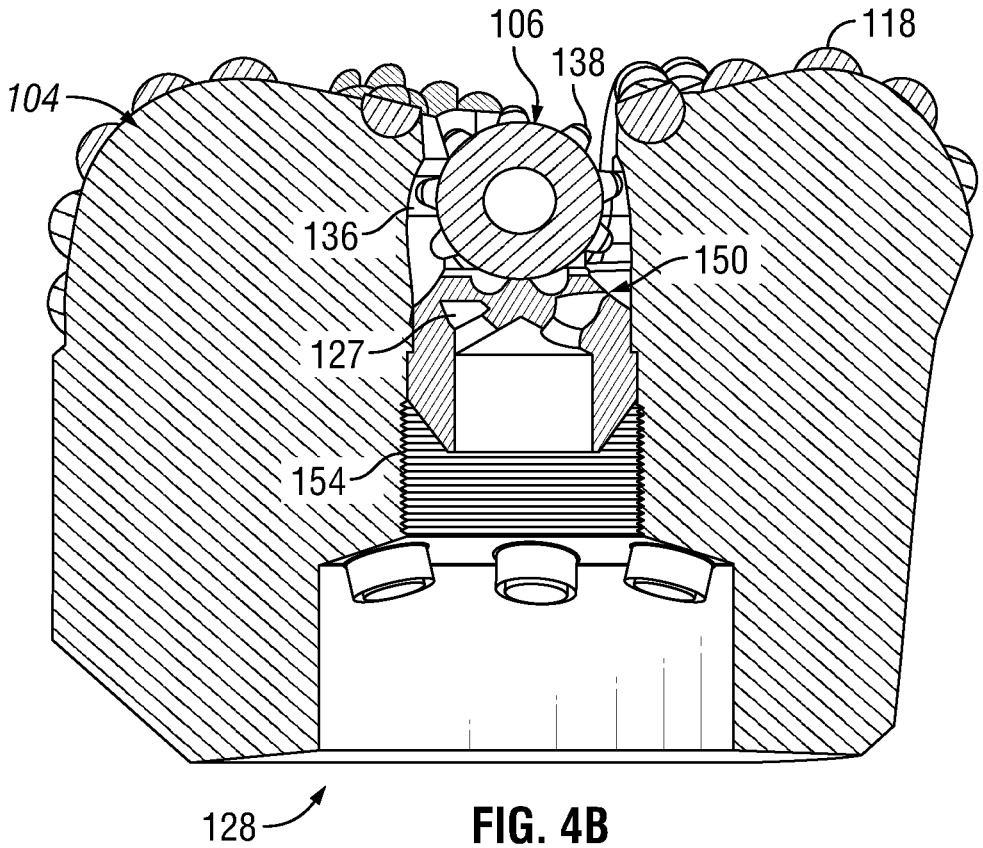

FIGS. 4A and 4B are cross-sectional views of the exemplary hybrid drill bit of FIGS. 2A and 2B.

In some embodiments, as illustrated in FIGS. 2A and 2B, and FIGS. 4A and 4B, the pair of counter-rotational cutting members 106 is radially disposed adjacent the bit body rotational axis "$X_0$." For example, the pair of counter-rotational cutting members 106 may be generally circumscribed by the blade 104. The first and second counter-rotational cutting members 132, 133 may be rotatably coupled to the bit body 102 by an axle 136. In some exemplary embodiments, the axle 136 is mounted in a fixed position with respect to the bit body 102 and the first and second counter-rotational cutting members 132, 133 are mounted for counter-rotation with respect to one another about the axle 136. Each first and second counter-rotational cutting member 132, 133 may be radially displaced from the bit body rotational axis "$X_0$," and thus the first and second counter-rotational cutting members 132, 133 may be induced to rotate on the axle 136 upon rotation of the hybrid drill bit 100.

For example, referring again to FIGS. 1 and 2A, rotation of the hybrid drill bit 100 adjacent the geologic formation "G" in the direction of arrow "A0" about the bit body rotational axis "$X_0$" induces rotation of the first counter-rotational cutting member 132 in the direction A1 and rotation of the second counter-rotational cutting member 133 in the opposite direction of arrow A2 about the axle 136. The rotation about the axle 136 is due in part to frictional forces between the geologic formation "G" and the first and second counter-rotational cutting members 132, 133 that induce rolling of the of the first and second counter-rotational cutting members 132, 133 along a circumferential path around the bit body rotational axis "$X_0$."

In some embodiments, the first and second counter-rotational cutting members 132, 133 support cutters 138 thereon. In some embodiments, the cutters 138 may be formed from a material similar to that of the cutters 118, for example, polycrystalline diamond. In other embodiments, the cutters 138 may be formed from a wide variety of hard materials including tungsten carbide. For example, cutters 138 may be formed from monotungsten carbide (WC), ditungsten carbide (W2C), macrocrystalline tungsten carbide, and cemented or sintered tungsten carbide. In some embodiments, the cutters 138 may be formed of hard materials including various metal alloys, for example, metal borides, metal carbides, metal oxides and metal nitrides.

The cutters 138 may generally operate to crush and scrape geologic material near the bit body rotational axis "$X_0$" of the bit body 102. In the illustrated aspect, the cutters 138 protrude from a generally hemispherical surface 140 of the first and second counter-rotational cutting members 132, 133. The first and second counter-rotational cutting members 132, 133 are arranged such that the respective hemispherical surfaces 140 define a substantially spherical profile across a leading end 142 of the first and second counter-rotational cutting members 132, 133. By substantially spherical it is meant that at least a portion (e.g., half) of the profile of the first and second counter-rotational cutting members 132, 133 is spherical. In some embodiments, an apex 144 of the generally spherical profile is disposed generally along the bit body rotational axis "$X_0$." Further, in some embodiments, the apex 144 is radially offset from bit body rotational axis "$X_0$."

In some embodiments, the apex 144 may be radially offset from the bit body rotational axis "$X_0$" such that one of the first and second counter-rotational cutting members 132, 133 intersects the bit body rotational axis "$X_0$" and the first and second counter-rotational cutting members 132, 133 extend to opposite radial sides of the bit body rotational axis "$X_0$." The cutters 138 may be arranged in circumferential rows around the hemispherical surfaces 140. Other arrangements for cutters 138 on the first and second counter-rotational cutting members 132, 133 are also contemplated such as dimples or blades in any random or patterned arrangement on the first and second counter-rotational cutting members 132, 133.

As illustrated in FIG. 4A, the pair of counter-rotational cutting members 106 may be coupled to the bit body 102 by a coupler 148. The coupler 148 may be disposed within a central bore 150 defined in the bit body 102, and in some embodiments, the coupler 148 includes an exterior threaded surface 152 defined on the pair of counter-rotational cutting members 106. The exterior threaded surface 152 engages a corresponding interior threaded surface 154 defined within the central bore 150. As illustrated, the exterior threaded surface 152 is fully engaged with the internally threaded surface 154. In this configuration, the first and second counter-rotational cutting members 132, 133 protrude from the bore 150 such that the pair of counter-rotational cutting members 106 are generally axially aligned with the cutters 118.

Figure 5:
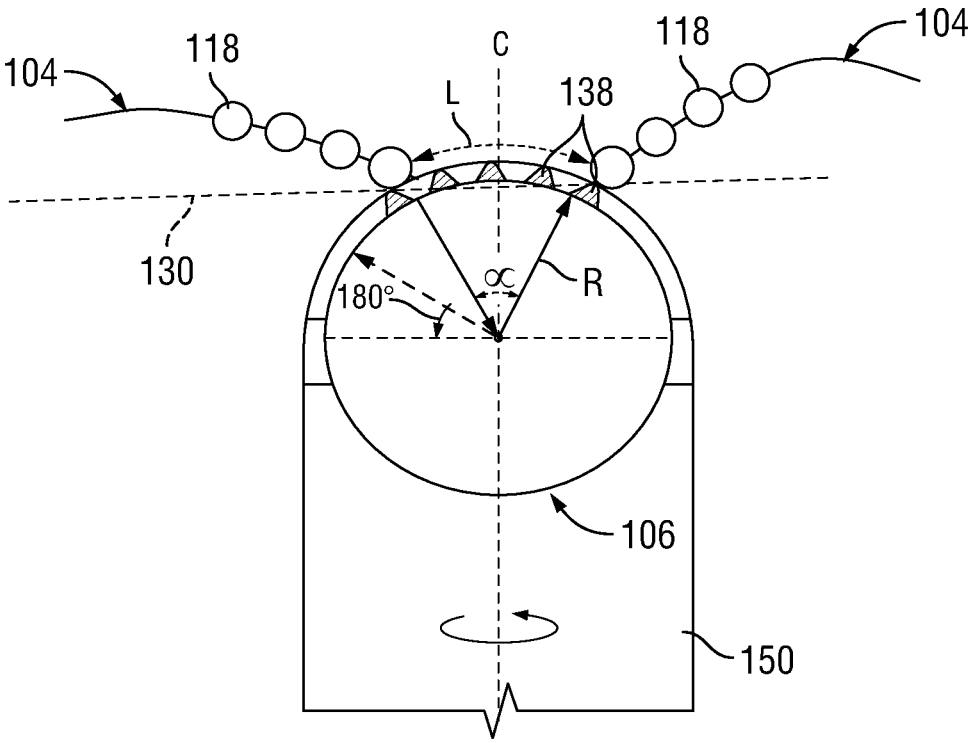
FIG. 5 is a side cross-sectional view of a drill bit illustrating a variation of an exposure angle between the rolling cutting structure and blades of the exemplary hybrid drill bit of FIG. 1, according to some embodiments.

FIG. 5 is a side cross-sectional view of a drill bit illustrating a variation of an exposure angle between the pair of counter-rotational cutting members and blades of the exemplary hybrid drill bit of FIG. 1, according to some embodiments.

In accordance with some embodiments, forces acting on the counter rotational cutter and exposure ranges of the counter rotational cutter with the formation may be predicted by varying the exposure angle between the counter rotational cutter 106 and the blade 104, in order to ensure the first and second counter-rotational cutting members 132, 133 of the pair of counter-rotational cutting members 106 continue to roll and not lock up from being over engaged with the rock of the formation.

In this sense, the leading end 142 of the first and second counter-rotational cutting members 132 may be axially positioned in the bore 150 at a predetermined angle of engagement or exposure angle "α", which defines an arc length of exposure "L" (of the, 133 pair of counter-rotational cutting members 106). That is, in some embodiments, the mounting of the pair of counter-rotational cutting members 106 further includes engaging the pair of counter-rotational cutting members 106 in the bore 150 at the predetermined exposure angle α from the plurality of blades. In some embodiments, the predetermined exposure angle α is defined as the angle between a center of rotation of the first and second counter-rotational cutting members 132, 133 and vertical tangents of any pair of the blades, as illustrated in FIG. 5. Further, in some embodiments, the arc length of exposure L can be defined as the portion of the pair of counter-rotational cutting members 106 intersecting with a plane 130 that passes through lowermost aspects of the innermost cutters 118, as illustrated in FIG. 5.

In order to minimize exposure of the pair of counter-rotational cutting members 106 to damaging interaction with the geological formation G, the predetermined exposure angle α can be maintained at values of less than 180°. It is advantageous to maintain the exposure angle α at values of less than 180° because the greater the exposure angle α approaching 180°, the longer the arc length of exposure L minimizing the tangential force keeping the pair of counter-rotational cutting members 106 rolling.

Advantageously, some embodiments maintain the exposure angle α at values of less than 180°. This configuration is advantageous to prevent forces from acting through the centerline and prevent the pair of counter-rotational cutting members 106 from rolling, e.g., locking-up of the pair of counter-rotational cutting members 106. When the forces act through the centerline, the cutters of the pair of counter-rotational cutting members 106 start to shear more geologic material than what they roll and crush. This carries the risk that some portions of the cutters break off of the pair of counter-rotational cutting members 106, thereby greatly diminishing or removing cutting efficiency gained by the pair of counter-rotational cutting members altogether, as well as causing other issued related to increased wear. For example, locking up accelerates wear rate of the carbide cutters of the pair of counter-rotational cutting members 106, puts a large load on the thrust bearings, and can gall both the journal and thrust bearing.

In some embodiments, the pair of counter-rotational cutting members 106 is mounted such that exposure of the pair of counter-rotational cutting members 106 to the geologic formation is limited to a leading portion of the pair of counter-rotational cutting members 106 to minimize damage to the pair of counter-rotational cutting members 106. Thus, the predetermined exposure angle or arc length of exposure can be between about 3° and about 180°. For example, the predetermined exposure angle can be about 10° to about 170°, about 20° to about 160°, about 30° to about 150°, about 40° to about 140°, about 50° to about 130°, about 60° to about 120°, about 70° to about 110°, about 80° to about 100°, about or 90°. Further, the predetermined exposure angle or arc length of exposure can be about 5° to about 175°, about 15° to about 165°, about 25° to about 155°, about 35° to about 145°, about 45° to about 135°, about 55° to about 125°, about 65° to about 115°, about 75° to about 105°, or about 85° to about 95°.

Mounting the pair of counter-rotational cutting members 106 at such angles provides an improved or optimized configuration for keeping the pair of counter-rotational cutting members 106 rolling and crushing, and for protecting the pair of counter-rotational cutting members 106 from damage (e.g., breaking of cutters 138) due to forces acting through the centerline thereof that cause stalling of pair of counter-rotational cutting members 106. Though recited in terms of certain ranges, it will be understood that all ranges from the lowest of the lower limits to the highest of the upper limits are included, including all intermediate ranges or specific angles, within this full range or any specifically recited range.

According to some embodiments disclosed herein, which permit installation of a roller cone or other bit from the upper connector section 102*b*, the pair of counter-rotational cutting members 106 can be configured to radially overlap with the blades 104. The radial overlap of the pair of counter-rotational cutting members 106 with the blades 104 limits the exposure of the pair of counter-rotational cutting members 106 to damage from rocks in the surrounding formation, thereby ensuring that only the most advanced portion of the first and second counter-rotational cutting members 132, 133 of the pair of counter-rotational cutting members 106 are in contact with the formation "G". As noted herein, this can tend to minimize the shear load against the pair of counter-rotational cutting members 106 and allow the pair of counter-rotational cutting members 106 to primarily roll and crush the rock. The change in the profile and radial overlap of the pair of counter-rotational cutting members 106 with the blades 104 will dictate whether or not a greater portion of the axial forces applied to the drill bit 100 will be transferred to the geologic formation "G" (FIG. 1) through each of the first and second counter-rotational cutting members 132, 133 than through the cutters 118. If the first and second counter-rotational cutting members 132, 133 are more recessed, this provides a greater extent of core drilled and potentially more stability. If the first and second counter-rotational cutting members 132, 133 axially lead the blades, the greater the exposure angle between the counter rotational cutter 106 and the blades 104 will be, thus opening more area up to roller/formation engagement.

In some embodiments, the pair of counter-rotational cutting members 106 may be mounted at an exposure angle $\alpha$ which leaves the pair of counter-rotational cutting members 106 underexposed. For example, the leading end 142 of the of the first and second counter-rotational cutting members 132, 133 may be disposed within the central bore 150, and in some embodiments, the leading end 142 may be disposed to trail each of the blades 104.

In some embodiments, the pair of counter-rotational cutting members 106 may be secured within the central bore 150 by other mechanisms including, but not limited to welding, brazing, snap ring, threaded ring, pinning, etc. The pair of counter-rotational cutting members 106 may include a pair of parallel axle supports 166 extending therefrom. In some embodiments, the axle supports 166 hold the axle 136 in a fixed or rigid manner generally orthogonal to the bit body rotational axis "$X_0$." Respective roller axes "$X_1$" and "$X_2$" are substantially aligned with one another such that the first and second counter-rotational cutting members 132, 133 are rotatable about a common axis extending generally perpendicular to the bit body rotational axis "$X_0$."

Referring back to FIG. 4A, according to some embodiments, the method of forming the hybrid drill bit 100 further includes mounting the rolling cutting member (e.g., the pair of counter-rotational cutting members) 106 to the bit body 102 by coupling an adjustment mechanism 149 between the drill bit body 102 and the pair of counter-rotational cutting members 106. The adjustment mechanism 149 is for selectively moving the pair of counter-rotational cutting members 106 to any of a plurality of user-selectable axial positions along the drill bit body, where axial in this context may be along rotational axis "$X_0$." The user in this context may be, for example, person(s) assembling and/or operating the drilling equipment. The adjustment mechanism allow the user to move the pair of counter-rotational cutting members 106 axially to a selected one of the axial positions, and also to maintain the pair of counter-rotational cutting members 106 at the selected position while drilling. The adjustment mechanism may be sufficiently robust that drilling does not cause the pair of counter-rotational cutting members 106 to move appreciably out of position, i.e. aside from wear, the axial position of the unloaded bit may be the same before, during, and after a drilling operation. After a drilling operation, the adjustment mechanism may be actuated or used to move the pair of counter-rotational cutting members 106 to another one of the user-selectable positions, after which drilling may be re-commenced. Thus, in one aspect, the adjustment mechanism may be used to position the rolling cutting structure at a first selected axial position, and a first drilling operation may be performed while maintaining the rolling cutting structure at the first selected axial position. The adjustment mechanism may then be used to move the rolling cutting structure to a second selected axial position, and a second drilling operation may be performed while maintaining the rolling cutting structure at the second selected axial position. Specific example embodiments of such an adjustment mechanism and how it may be manufactured, configured, adjusted, and/or used while drilling are further provided below.

In some embodiments, the adjustment mechanism 149 includes the exterior threaded surface 152 of the coupler 148 defined on the pair of counter-rotational cutting members 106 and the interior threaded surface 154 defined within the central bore 150 to engage the exterior threaded surface 152.

In some embodiments, the pair of counter-rotational cutting members 106 is statically supported at one of a plurality of possible axial positions within the central bore 150 defined in the bit body 102. One or more substantially rigid spacers (not shown) may be provided within the central bore 150 to define the axial position of the pair of counter-rotational cutting members 106 with respect to the bit body 102. The number and thickness of the spacers may be selected to determine the distance the threaded surface 152 of the coupler 148 will thread into the central bore 150, and thereby defines the axial position of the pair of counter-rotational cutting members 106 with respect to the bit body 208. The substantially rigid spacers may comprise flat steel washers.

In some embodiments, the adjustment mechanism 149 may be described as a "static" adjustment mechanism since the axial position of the pair of counter-rotational cutting members 106 is maintained as the hybrid drill bit 100 is operating within the wellbore 14 (FIG. 1). When it is desired to alter the axial position of the pair of counter-rotational cutting members 106, the drill bit 100 may be withdrawn from the wellbore 14 and the pair of counter-rotational cutting members 106 may be unthreaded from the bit body 102 to a desired degree.

With continued reference to FIGS. 1 through 5, the hybrid drill bit 100 may be employed for forming wellbore 14 through geologic formation "G." In some embodiments, the geologic formation "G" may initially be evaluated to assess an appropriate axial position of the pair of counter-rotational cutting members 106 with respect 5 to the cutters 118. For example, the type of geologic materials within the geologic formation "G" may be assessed to determine an appropriate cutting depth for the cutters 118, and a hybrid drill bit 100 with an appropriate axial position of the counter-rotational cutting structure 106 may be selected to achieve the appropriate cutting depth. A weight applied to the cutters 118 and a corresponding cutting depth of the cutters 118 may be defined by the axial position of the pair of counter-rotational cutting members 106, the exposure angle between the counter rotational cutter 106 and the blades 104, aggressiveness of the pair of counter-rotational cutting members 106 and depth of cut available of the pair of counter-rotational cutting members 106.

Next, the hybrid drill bit 100 may be coupled to the drill string 18 with the connector 108, and the bit body 102 of the hybrid drill bit 100 may be rotated about the bit body rotational axis "$X_0$" adjacent the geologic formation "G." By rotating the bit body 102, geologic material may be sheared from the geologic formation "G" with the cutters 118. The rotation of the bit body 102 causes the first and second counter-rotational cutting members 132, 133 to roll in opposite directions along the geologic formation "G." The first counter-rotational cutting member 132 rolls in the direction of arrow A1, and the second counter-rotational cutting member 133 rolls in the direction of arrow A2. The first and second counter-rotating cutting members 132, 133 both rotate about the axle 136 and axis A1 that is generally orthogonal to the bit body rotational axis "$X_0$." Geologic material from the geologic formation "G" is thereby crushed and scraped with the cutters 138 near the bit body rotational axis "$X_0$."

In some embodiments, the at least one pair of counter-rotational cutting members 106 includes first and second counter-rotational cutting members 132, 133 mounted to extend to opposite radial sides of the bit body rotational axis "$X_0$." In some embodiments, the first and second counter-rotational cutting members 132, 133 each have a generally hemispherical profile, and in some embodiments, the first and second counter-rotational cutting members 132, 133 are oriented with respect to one another to define a generally spherical profile across the leading end 142 of the pair of counter-rotational cutting members 106.

In some embodiments, an apex of the generally spherical profile is disposed generally along the bit body rotational axis "$X_0$." In some embodiments, the first and second counter-rotational cutting members 132, 133 are mounted on a common axis. In some embodiments, the at least one of the first and second counter-rotational cutting member 132, 133 intersects the rotational axis and extends to opposite radial sides of the bit body rotational axis.

Various examples of aspects of the disclosure are described as numbered clauses (1, 2, 3, etc. . . . ) for convenience. These are provided as examples and do not limit the subject technology. Identification of the figures and reference numbers are provided below merely as examples for illustrative purposes, and the clauses are not limited by those identifications.

Clause 1. A method of forming a hybrid drill bit for drilling through a geologic formation, the method comprising: forming a bit body having a rotational axis, a central bore along the rotational axis, a lower end portion, a plurality of blades at the lower end portion, and an upper connector section for coupling to a lower end of a drill string, each of the plurality of blades extending radially from the bit body about the rotational axis at the lower end portion and including a plurality of cutters embedded therein, and inserting a rolling cutting structure into the central bore from the upper connector section of the bit body along the rotational axis toward the lower end portion.

Clause 2. The method of Clause 1, further comprising mounting the rolling cutting element to the bit body by coupling an adjustment mechanism between the bit body and the rolling cutting structure, the adjustment mechanism for maintaining the rolling cutting structure at any one of a plurality of selectable axial positions while drilling.

Clause 3. The method of Clause 2, wherein the mounting the rolling cutting structure further comprises engaging the rolling cutting element in the central bore at a predetermined exposure angle of less than 180°.

Clause 4. The method of Clause 3, further comprising using the adjustment mechanism to position the rolling cutting structure at a first selected axial position; performing a first drilling operation while maintaining the rolling cutting structure at the first selected axial position; using the adjustment mechanism to move the rolling cutting structure to a second selected axial position; and performing a second drilling operation while maintaining the rolling cutting structure at the second selected axial position.

Clause 5. The method of Clause 1, wherein the coupling the rolling cutting structure further comprises coupling an adjustment mechanism between the bit body and the rolling cutting structure for supporting the rolling cutting structure at a plurality of axial positions along the bit body rotational axis.

Clause 6. The method of Clause 1, wherein the rolling cutting structure comprises a substantially spherical profile.

Clause 7. The method of Clause 6, wherein the inserting comprises positioning the rolling cutting structure within the central bore relative to the blades such that exposure of the rolling cutting structure to the geologic formation is limited to a leading portion of the rolling cutting structure.

Clause 8. The method of Clause 7, wherein the leading portion of the rolling cutting structure has a predetermined arc length of exposure of less than 180°.

Clause 9. The method of Clause 1, wherein the rolling cutting structure comprises two counter-rotational cutting members mounted about respective roller axes extending generally perpendicular to the bit body rotational axis.

Clause 10. The method of Clause 1, wherein the mounting the rolling cutting structure further comprises engaging the rolling cutting structure in the central bore at a predetermined exposure angle of less than 180°.

Clause 11. The method of Clause 10, wherein the predetermined exposure angle is between about 3° and less than 180°.

Clause 12. The method of Clause 10, wherein the predetermined exposure angle is about 10° to about 170°, about 20° to about 160°, about 30° to about 150°, about 40° to about 140°, about 50° to about 130°, about 60° to about 120°, about 70° to about 110°, about 80° to about 100°, or about 90°.

Clause 13. The method of Clause 10, wherein the predetermined exposure angle is about 5° to about 175°, about 15° to about 165°, about 25° to about 155°, about 35° to about 145°, about 45° to about 135°, about 55° to about 125°, about 65° to about 115°, about 75° to about 105°, or about 85° to about 95°.

Clause 14. The method of Clause 1, wherein the plurality of blades circumferentially disposed about the bit body define an opening on the upper portion of the bit body, wherein at least a portion of the rolling cutting structure is exposed to the geologic formation through the opening, and wherein a size of the central bore or a cross-sectional profile of the rolling cutting structure is larger than a size of the bit body opening.

Clause 15. The method of Clause 14, wherein the size of the bit body opening is a diameter of an inscribed circle defined by an innermost surface of each of the plurality of blades, and wherein the size of the bore comprises a diameter of the bore.

Clause 16. A drill bit for forming a wellbore through a geologic formation, the drill bit comprising: a bit body having a lower end portion, an upper connector section coupled to a lower end of a drill string, a lower end portion, a rotational axis extending longitudinally through the bit body, and a central bore along the rotational axis, the bit body further including a plurality of blades extending radially from the bit body about the rotational axis at the lower end portion, each of the blades including a plurality of cutters embedded therein, wherein the plurality of blades extend radially from the bit body about the rotational axis to define an opening on the upper portion of the bit body; and a pair of counter-rotational cutting members mounted in the bit body central bore, wherein a size of the central bore or a cross-sectional profile of the pair of counter-rotational cutting members is larger than a size of the bit body opening.

Clause 17. The drill bit of Clause 16, wherein the size of the bit body opening comprises a diameter of an inscribed circle defined by an innermost surface of each of the plurality of blades, and wherein the size of the bore comprises a diameter of the bore.

Clause 18. The drill bit of Clause 16, wherein at least a portion of the pair of counter-rotational cutting members is exposed to the geologic formation through the opening.

Clause 19. The drill bit of Clause 16, wherein the pair of counter-rotational cutting members comprises two counter-rotational cutting members mounted about respective roller axes and generally perpendicular to the bit body rotational axis, and wherein the respective roller axes are aligned such that the two counter-rotational cutting members are rotatable about a common roller axis extending generally perpendicular to the bit body rotational axis.

Clause 20. The drill bit of Clause 19, wherein the respective roller axes are offset from one another such that the two counter-rotational cutting members are rotatable about distinct axes extending generally perpendicular to the bit body rotational axis.

Clause 21. The drill bit of Clause 19, wherein the pair of counter-rotational cutting members comprises an axle supporting the two counter-rotational cutting members thereon.

Clause 22. The drill bit of Clause 16, wherein the pair of counter-rotational cutting members includes a coupler thereon for coupling the pair of counter-rotational cutting members into the central bore.

Clause 23. The drill bit of Clause 16, wherein the pair of counter-rotational cutting members is positioned in the bore at a predetermined exposure angle of less than 180°.

Clause 24. The drill bit of Clause 23, wherein the predetermined exposure angle is about 3° and about 180°.

Clause 25. The method of Clause 23, wherein the predetermined exposure angle is about 10° to about 170°, about 20° to about 160°, about 30° to about 150°, about 40° to about 140°, about 50° to about 130°, about 60° to about 120°, about 70° to about 110°, about 80° to about 100°, or about 90°.

Clause 26. The method of Clause 23, wherein the predetermined exposure angle is about 5° to about 175°, about 15° to about 165°, about 25° to about 155°, about 35° to about 145°, about 45° to about 135°, about 55° to about 125°, about 65° to about 115°, about 75° to about 105°, or about 85° to about 95°.

Clause 27. The drill bit of Clause 16, wherein the cutters of each blade are spaced from one another on a radially outer side of the pair of counter-rotational cutting members.

Clause 28. A drill bit for forming a wellbore through a geologic formation, the drill bit comprising: a bit body having a lower end portion, an upper connector section for coupling to a lower end of a drill string, a rotational axis extending longitudinally through the bit body, and a central bore along the rotational axis, the bit body further including a plurality of blades extending radially from the bit body about the rotational axis at the lower end portion, each of the blades including a radially innermost cutter embedded therein, the plurality of radially innermost cutters defining an opening therebetween at the lower end portion of the bit body; and a pair of counter-rotational cutting members mounted in the bit body central bore and positioned relative to the radially innermost cutters to provide a predetermined exposure of the pair of counter-rotational cutting members through the opening.

Clause 29. The drill bit of Clause 28, wherein a size of the central bore or a cross-sectional profile of the pair of counter-rotational cutting members is larger than a size of the bit body opening.

Clause 30. The drill bit of Clause 29, wherein a size of the bit body opening comprises a diameter of an inscribed circle defined by an innermost surface of each of the plurality of blades, and wherein a size of the bore comprises a diameter of the bore.

Clause 31. The drill bit of Clause 28, wherein at least a portion of the pair of counter-rotational cutting members is exposed to the geologic formation through the opening.

Clause 32. The drill bit of Clause 28, wherein the pair of counter-rotational cutting members comprises two counter-rotational members mounted about respective roller axes and generally perpendicular to the bit body rotational axis, and wherein the respective roller axes are aligned such that the two counter-rotational members are rotatable about a common roller axis extending generally perpendicular to the bit body rotational axis.

Clause 33. The drill bit of Clause 32, wherein the respective roller axes are offset from one another such that the two counter-rotational cutters are rotatable about distinct axes extending generally perpendicular to the bit body rotational axis.

Clause 34. The drill bit of Clause 28, wherein the pair of counter-rotational cutting members includes a coupler thereon for coupling the pair of counter-rotational cutting members into the central bore.

Clause 35. The drill bit of Clause 28, wherein the predetermined exposure of the pair of counter-rotational cutting members through the opening is defined by a predetermined exposure angle.

Clause 36. The drill bit of Clause 35, wherein the predetermined exposure angle is about 3° and about 180°.

Clause 37. The method of Clause 35, wherein the predetermined exposure angle is about 10° to about 170°, about 20° to about 160°, about 30° to about 150°, about 40° to about 140°, about 50° to about 130°, about 60° to about 120°, about 70° to about 110°, about 80° to about 100°, or about 90°.

Clause 38. The method of Clause 32, wherein the predetermined exposure angle is about 5° to about 175', about 15° to about 165°, about 25° to about 155°, about 35° to about 145°, about 45° to about 135°, about 55° to about 125°, about 65° to about 115°, about 75° to about 105°, or about 85° to about 95°.

Clause 39. The drill bit of Clause 28, wherein the predetermined exposure of the pair of counter-rotational cutting members through the opening is defined by a predetermined arc of exposure.

Clause 40. The drill bit of Clause 39, wherein the predetermined arc of exposure is about 3° and about 180°.

Clause 41. The method of Clause 39, wherein the predetermined arc of exposure is about 10° to about 170°, about 20° to about 160', about 30° to about 150°, about 40° to about 140°, about 50° to about 130°, about 60° to about 120°, about 70° to about 110°, about 80° to about 100°, or about 90°.

Clause 42. The method of Clause 39, wherein the predetermined arc of exposure is about 5° to about 175°, about 15° to about 165°, about 25° to about 155°, about 35° to about 145°, about 45° to about 135°, about 55° to about 125°, about 65° to about 115°, about 75° to about 105°, or about 85° to about 95°.

Clause 43. The drill bit of Clause 28, wherein the pair of counter-rotational cutting members comprises an axle supporting the two counter-rotational members thereon.

Clause 44. A method of assembling a hybrid drill bit, the method comprising inserting a rolling cutting structure into a central bore of a bit body through an upper connector section of the bit body toward a lower end portion of the bit body, the bit body having a rotational axis and a plurality of blades at the lower end portion, the upper connector section being coupled to the lower end portion, each of the plurality of blades extending radially from the bit body about the rotational axis at the lower end portion, each of the plurality of blades including a plurality of cutters embedded therein.

Clause 45. The method of Clause 44, wherein the inserting comprises moving the rolling cutting structure along the rotational axis until being interposed between the plurality of blades at the lower end portion.

What is claimed is:

1. A method comprising:

forming a bit body having a rotational axis, a central bore along the rotational axis, a lower end portion, a plurality of blades at the lower end portion, and an upper connector section for coupling to a lower end of a drill string, each of the plurality of blades extending radially from the bit body about the rotational axis at the lower end portion, and including a plurality of cutters embedded therein; and inserting a rolling cutting structure into the central bore from the upper connector section of the bit body such that the rolling cutting structure moves along the rotational axis from the upper connector section toward the lower end portion of the bit body; and mounting the rolling cutting structure to the lower end portion of the bit body by coupling an adjustment mechanism between the bit body and the rolling cutting structure, the adjustment mechanism for maintaining the rolling cutting structure at any one of a plurality of selectable axial positions while drilling, and wherein each of the plurality of selectable axial positions is configured to position at least part of a leading portion of the rolling cutting structure exterior to the bit body.

2. The method of claim 1, wherein each of the plurality of selectable axial positions comprises a predetermined exposure angle of less than 180°, wherein the angle of exposure is defined as the angle between vertical tangents of a first blade and a second blade of the plurality of blades with a vertex of the angle at a center of rotation of the rolling cutting structure.

3. The method of claim 1, further comprising:

using the adjustment mechanism to position the rolling cutting structure at a first selected axial position;

performing a first drilling operation while maintaining the rolling cutting structure at the first selected axial position;

using the adjustment mechanism to move the rolling cutting structure to a second selected axial position; and performing a second drilling operation while maintaining the rolling cutting structure at the second selected axial position.

4. The method of claim 1, wherein the rolling cutting structure comprises a spherical profile.

5. A method comprising:

forming a bit body having a rotational axis, a central bore along the rotational axis, a lower end portion, a plurality of blades at the lower end portion, and an upper connector section for coupling to a lower end of a drill string, each of the plurality of blades extending radially from the bit body about the rotational axis at the lower end portion, and including a plurality of cutters embedded therein;

inserting a rolling cutting structure into the central bore from the upper connector section of the bit body along the rotational axis toward the lower end portion; wherein the rolling cutting structure comprises a substantially spherical profile; and positioning the rolling cutting structure within the central bore relative to the blades such that at least part of a leading portion of the rolling cutting structure protrudes through an opening to a position exterior the bit body, wherein the opening is defined by a gap between radially innermost cutters of the plurality of cutters from the central bore to an exterior of the drill bit at the lower end portion of the bit body, and wherein a diameter of the rolling cutting structure is greater than a size of the opening.

6. The method of claim 5, wherein the leading portion of the rolling cutting structure comprises less than 180° of a circumference of the rolling cutting structure such that less than half of the rolling cutting structure protrudes through the opening into the position exterior to the bit body.

7. A method comprising:

forming a bit body having a rotational axis, a central bore along the rotational axis, a lower end portion, a plurality of blades at the lower end portion, and an upper connector section for coupling to a lower end of a drill string, each of the plurality of blades extending radially from the bit body about the rotational axis at the lower end portion, and including a plurality of cutters embedded therein; wherein the plurality of blades extending radially from the bit body about the rotational axis define an opening on the lower end portion of the bit body; and inserting a rolling cutting structure into the central bore from the upper connector section of the bit body along the rotational axis toward the lower end portion, wherein at least part of a leading portion of the rolling cutting structure protrudes through the opening on the lower end portion of the bit body to a position exterior to the bit body, and wherein a size of the central bore or a cross-sectional profile of the rolling cutting structure is larger than a size of the opening.

8. A drill bit for forming a wellbore through a geologic formation, the drill bit comprising:

a bit body having a lower end portion, an upper connector section for coupling to a lower end of a drill string, a rotational axis extending longitudinally through the bit body, and a central bore along the rotational axis, the bit body further including a plurality of blades extending radially from the bit body about the rotational axis at the lower end portion, and including a plurality of cutters embedded therein, wherein the plurality of blades extend radially from the bit body about the rotational axis to define an opening on the lower end portion of the bit body; and a pair of counter-rotational cutting members mounted in the central bore, wherein a size of the central bore or a cross-sectional profile of the pair of counter-rotational cutting members is larger than a size of the opening, and wherein at least part of a leading end of the pair of counter-rotational cutting members protrudes through the opening to a position exterior the bit body.

9. The drill bit of claim 8, wherein the size of the opening comprises a diameter of an inscribed circle defined by an innermost surface of each of the plurality of blades, and the size of the central bore comprises a diameter of the central bore.

10. The drill bit of claim 9, wherein the pair of counter-rotational cutting members is positioned in the bore at a predetermined exposure angle of less than 180°, wherein the angle of exposure is defined as the angle between opposing sides of the inscribed circle with a vertex of the angle at a center of rotation of the pair of counter-rotational cutting members.

11. The drill bit of claim 10, wherein the predetermined exposure angle is between 3° and 180°.

12. A drill bit for forming a wellbore through a geologic formation, the drill bit comprising:

a bit body having a lower end portion, an upper connector section for coupling to a lower end of a drill string, a rotational axis extending longitudinally through the bit body, and a central bore along the rotational axis, the bit body further including a plurality of blades extending radially from the bit body about the rotational axis at the lower end portion, each of the blades including a radially innermost cutter embedded therein, the plurality of radially innermost cutters defining an opening therebetween at the lower end portion of the bit body; and a rolling cutting structure mounted in the bit body central bore, wherein at least part of a leading portion of the rolling cutting structure is configured to protrude through the opening to a position exterior to the bit body, and wherein a size of the central bore or a cross-sectional profile of the rolling cutting structure is larger than a size of the bit body opening.

13. The drill bit of claim 12, wherein the rolling cutting structure includes a coupler thereon for coupling the rolling cutting structure to the bit body in the central bore.

14. The drill bit of claim 12, wherein the size of the opening comprises a diameter of an inscribed circle defined by an innermost surface of each of the plurality of radially innermost cutters.

15. The drill bit of claim 14, wherein an exposure angle for the part of the leading portion positioned exterior the bit body is between 3° and 180°, wherein the exposure angle is defined as the angle between opposing sides of the inscribed circle with a vertex of the angle at a center of rotation of the rolling cutting structure.

16. The drill bit of claim 12 wherein the part of the leading portion positioned exterior the bit body comprises less than 180° of a circumference of the rolling cutting structure such that less than half of the rolling cutting structure protrudes through opening to a position exterior the bit body.

17. The drill bit of claim 16, wherein the part of the leading portion positioned exterior the bit body comprises between 3° and 180° of the circumference of the rolling cutting structure.

18. The drill bit of claim 12, wherein the rolling cutting structure comprises a pair of counter-rotational cutting members including an axle supporting each counter-rotational cutting member of the pair of counter-rotational cutting members thereon.

* * * * *